United States Patent [19]

Saurman

[11] 4,254,520

[45] Mar. 10, 1981

[54] BATIK PROCESS AND APPARATUS

[76] Inventor: Judith B. Saurman, Box 310 Woodbine Rd., Shelburne, Vt. 05482

[21] Appl. No.: 947,188

[22] Filed: Sep. 29, 1978

[51] Int. Cl.[3] ..... D06P 5/12

[52] U.S. Cl. ..... 8/447; 206/503; 427/155; 427/282

[58] Field of Search ..... 8/65, 447

[56] References Cited

U.S. PATENT DOCUMENTS

| | | | |
|---|---|---|---|
| 1,453,076 | 4/1923 | Levine | 8/65 X |
| 1,553,721 | 9/1925 | Scholz | 8/65 X |
| 1,656,932 | 1/1928 | Adler | 8/65 X |
| 1,903,175 | 3/1933 | Fischesser | 8/65 X |

OTHER PUBLICATIONS

Butterworths, (publ.), *An Introduction to Textile Printing,* p. 143 (1964).

*Primary Examiner*—Wilbert J. Briggs, Sr.
*Attorney, Agent, or Firm*—Hume, Clement, Brinks, Willian & Olds, Ltd.

[57] ABSTRACT

A process for waxing fibrous material for wax resist dyeing processes and such wax resist dyeing processes are provided wherein the material to be waxed is positioned adjacent a source of wax and a source of heat is applied opposite the source of wax for a sufficient period of time to melt the wax and to allow wax penetration of the material. Also provided is a heat pen and a kit including a heat pen and at least one wax tray for use in the processes.

4 Claims, 10 Drawing Figures

BATIK PROCESS AND APPARATUS

TECHNICAL FIELD

This invention relates to an improved process for the technical field of dyeing a design or pattern onto a fibrous material by dyeing fibrous material which has been partially waxed to resist dye. This field includes batik work, an Indonesian craft wherein fabric is partially coated with wax, dipped into cold dye, boiled to remove the wax, and then rewaxed. This field also includes variations of traditional batik work in which selected dyeing is achieved by wax resist, i.e., waxing to render an area resistant to dye.

This invention also relates to improved instruments and apparatus for waxing fibrous material for wax resist dyeing processes.

BACKGROUND OF THE INVENTION

Wax resist dyeing processes are exemplified by batik work, and will be so described here for simplicity, but the invention and its background are not strictly limited to batik work and the invention is applicable to any wax resist dyeing process, and may be used regardless of whether the fibrous material being patterned is a cloth fabric or paper or the like. Moreover, the descriptions below of batik work will pertain mainly to modern batik work techniques.

In batik work, a fabric is partially waxed, leaving select portions thereof receptive to dye, and is dyed under conditions that do not disturb the waxing. Depending on the design intended, the fabric is then treated to remove the wax, or is rewaxed about additional area. For instance, to produce various shades of a given color, the fabric is first waxed to protect any portion on which the color is not desired, then dyed to a light shade, then rewaxed to preserve the light shade where desired, then redyed a darker shade and so forth. Similar techniques are used to produce tone variations. The essence of the technique is protecting portions with wax.

The kind of wax used can vary, but a typical wax is a mixture of paraffin and beeswax which is solid at room temperature. To adequately protect the fabric, the wax must penetrate from one side through to the other. (Traditional native practice was to apply the wax from both sides of the fabric.)

Molten wax is applied to the desired portions of the fabric that is disposed horizontally or near horizontally. The wax is applied to one side of the fabric only and must not cool during the batik waxing process before it penetrates to the opposite side of the fabric. Most all attempts to rework an area by reapplying wax thereto produce uneven, undesirable results. It generally is not possible to determine the extent of wax penetration until the fabric is reversed.

The wax can be applied with a tjanting tool, which includes a small copper cup with a spout or tube extending outwardly and downwardly from the bottom of the cup, and a suitable handle. Spouts vary from slender to wide and flat, and tjanting tools may have more than one spout from the same cup to apply the wax in parallel lines. A brush is often used and the brush can be pointed or wedge-shaped. A wedge-shaped brush can be rotated to produce a very fine line or a broader one. A wooden block or tjap can also be used to apply wax designs to the material.

The wax is melted over boiling water, such as in a double boiler heated on a stove, hot place, alcohol burner, or the like. Melting wax over a direct flame is extremely dangerous. To avoid premature cooling of the wax, the artisan works in close proximity to the heat source and transfers the molten wax quickly from the heat source to the fabric. These techniques require extreme care to be taken when heating and transporting molten wax to avoid injury to the artisan or to the fabric being worked. For many batik workers, particularly the novice and those working together in groups, these techniques are extremely dangerous.

This method of waxing fabric has many other disadavantages. Work cannot begin until the wax is heated to the appropriate temperature, which usually takes about 45 minutes. Control of the wax temperature at the moment of application is poor at best, and discourages batik working on temperature sensitive fabrics, particularly for the novice. Line control with traditional tools and brushes is poor and inconsistant. Tjanting tools are relatively expensive and a variety of tools are necessary to create intricate designs. Brushes must be of a high quality, and once used for waxing, are no longer suitable for other purposes. The brush bristles can be ruined if contacted with hot surfaces, such as the apparatus used to melt the wax.

Most of these disadvantages are multipled when more than one worker is present, and therefore the teaching of batik work, particularly to children is difficult.

It is an object of the present invention to provide a waxing process and the apparatus therefor that eliminates the open heating of wax and the need to transport hot wax from place to place. It is an object to provide a waxing process and apparatus that substantially eliminates the chance of the wax cooling during application and that provides greater heat control. It is a further object to provide a waxing process and apparatus that allows the artisan to determine wax penetration while working. It is an object to provided a waxing process that does not require brushes, tjanting tools, or the like. Another object is to provide an apparatus for waxing that reduces the time for heating the wax and provides more consistent line control.

DISCLOSURE OF THE INVENTION

The foregoing and other objects are realized in accordance with the invention by a process in which the fibrous material being worked is placed over solid wax and heat is applied from above to selected areas of the material, melting the wax below, whereby such areas are penetrated by the wax and rendered dye resistant. The wax is preferably contained in a shallow tray, which can conveniently be placed in an oven or the like to create a flat wax surface upon melting the wax and thereafter cooled at the artisan's convenience. (During the actual waxing process the tray of wax is preferably at ambient room temperature.) The heat is preferably applied with a heat pen that supplied controlled, localized heat. The heat pen is a hand operable, electrically heated tool, which may have interchangeable pen tips.

The process and apparatus of the present invention allows an artisan to confine the wax and source of heat for melting the wax to the immediate area of the material being worked. Only a small amount of melted wax need be present and that melted wax is concomitantly penetrating the material. The artisan faces the side of the material opposite that to which the wax is applied, and can visually determine when wax penetration is complete. The temperature of the heat pen can easily be controlled. The heat pen provides greater line control than traditional instruments. A novice worker can safely and easily achieve gratifying results while maintaining the principle of wax resist dyeing processes.

PREFERRED EMBODIMENTS OF THE INVENTION

Figure 1:
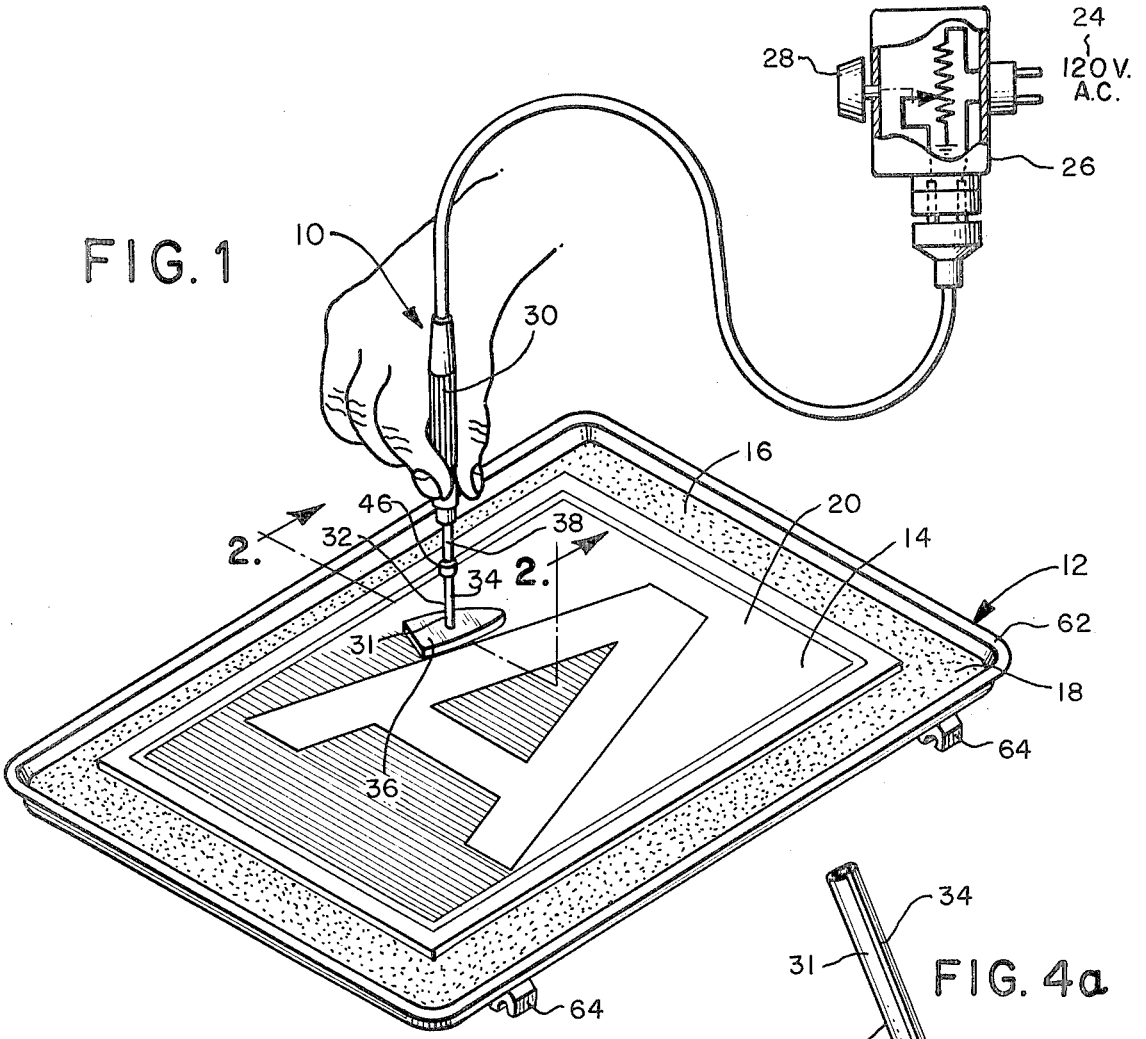
FIG. 1 is a partially cut-away perspective view of a heat pen and wax tray being employed in a wax resist dyeing process embodying features of the present invention.

Referring now to the drawings, particularly FIG. 1, there is illustrated a heat pen, designated generally by the reference numeral 10, and a tray of wax, designated generally by the reference numeral 12, being employed in a waxing process for a wax resist dyeing process within the present invention. A fabric 14 overlies the upper surface 17 of solid wax 18 held in the wax tray 12. The heat pen 10 is being used to apply heat to the upper surface 20 of the fabric 14 opposite the surface in contact with the wax 18. Application of heat to a localized area of the fabric 14 melts the immediately underlying wax 18, which wax flows upwardly, penetrating the fabric 14 and waxing that portion of the fabric 14. After the wax 18 has penetrated an area of the fabric 14, the heat pen 10 is moved to another areas of the fabric 14 and the process is repeated until the desired design to be dyed, 22 shown as an A-Figure, is the only portion of fabric 14 not waxed. All of the equipment necessary to wax the design 22 is confined to a small area and only an insignificant portion of the wax 18 is in the molten state at any given time. The artisan is working from the upper surface 20 of the fabric 14, opposite the side to which the wax 18 is being applied, and can visually observe the extent of wax penetration.

Figure 2:
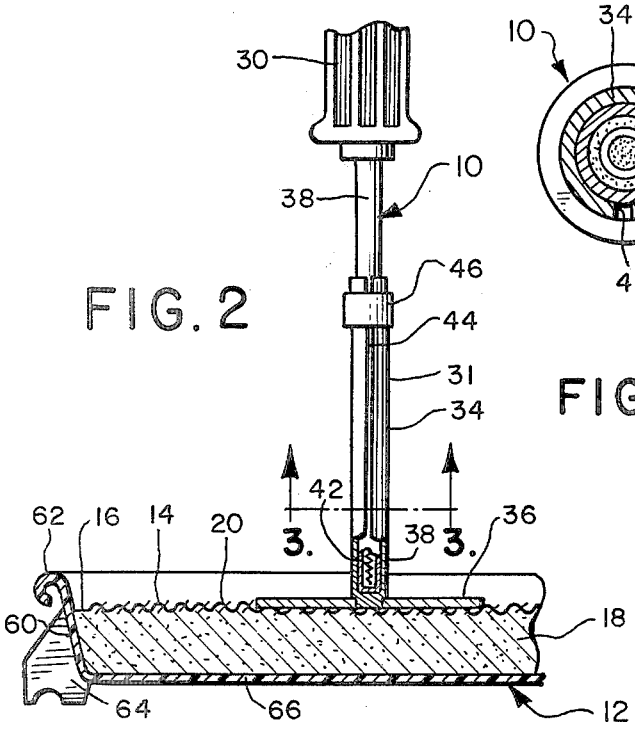
FIG. 2 is an elevated side view of the heat pen and wax tray of FIG. 1 in partial cross section along line 2—2 of FIG. 1.

Referring now to FIG. 2 also, the heat pen is connected to a source of electrical current 24 preferably through a rheostat 26 which provides a sensitive means for controlling the heat applied to the fabric 14. The rheostat 26 preferably is equipped with a dial 28 which can be conveniently labelled to designate the temperature setting. A typical designation may include marking the dial 28 from "low" to "high," or alternatively, the dial may designate the types of fabric for which the various dial settings should be utilized. Optimum heat can be obtained within three minutes after the heat pen 10 is turned on.

The heat pen 10 includes a handle 30 adapted to be grasped by hand. The heat pen 10 and handle 30 as illustrated are an adaptation of a 15 watt, 110 to 120 volt soldering iron. The handle 30 is formed of a heat and current resistant material, such as plastic.

The heat pen 10 includes a pen tip 31 such as the flat pen tip 32 illustrated in FIGS. 1 and 2. The flat pen tip 32 is preferably formed of a metal alloy, such as aluminum, and includes a bored, cylindrical stem 34 that is open at one end, and a flat-bottomed triangled base 36. The flat pen tip 32 is particularly adapted for waxing large areas of the fabric 14, or alternatively, for spot smoothing the upper surface 16 of the wax 18.

The flat-bottom base 36 of the flat-pen tip 32 is applied directly to the fabric 14 to melt the immediately-underlying wax 18, as is best shown in FIG. 2. To achieve even wax penetration, the upper surface 16 of the wax 18 should be smooth. The upper surface 16 can be smoothed either by localized heating with the flat pen tip 32 or by heating the entire wax tray 12 in an oven or the like. An artisan would preferably work with a plurality of wax trays 12, substituting a fresh wax tray 12 with a smooth upper surface 16, whenever the wax tray 12 is used to the extent that the upper wax surface 16 becomes irregular. The wax trays 12 can be set aside until it is convenient to oven heat them to restore the upper surface 16 of the wax 18. The waxing work need not be interrupted. Since the fabric 14 is laid directly upon the wax 18, all wax trays 12 and the wax 18 contained therein should be preferable at ambient room temperature during use.

The wax tray 12 should preferably be filled with wax 18 to a depth of $\frac{1}{2}$ inch. A depth of $\frac{1}{4}$ inch of solid wax 18 is believed the minimum that should be used. A greater depth of wax 18 can, of course, be used, but such an amount is believed unnecessary and would require deeper wax trays 12 that would be more cumbersome to store and to oven heat. The preferred wax 18 is a mixture of $\frac{2}{3}$ parts of parraffin and $\frac{1}{3}$ part of beeswax, although the choice of wax will depend on personal preference and the fabric 14 to be used and other such factors.

Figure 3:
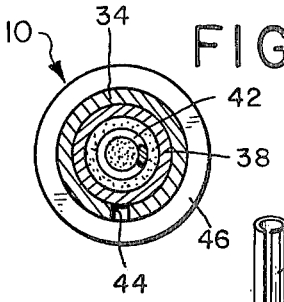
FIG. 3 is a cross-sectional view of the heat pen of FIG. 1, taken along line 3—3 of FIG. 2.

As mentioned above, the heat pen 10 illustrated is an adaptation of a soldering iron. Referring now to FIG. 3 also, the heat pen 10 has a stem which includes in cross section an annular sheath 38 which surrounds a concentric heating element 42. The bored cylindrical stem 34 of the flat pen 32 encircles the annular sheath 38 and includes a slit 44 to allow for expansion or contraction on heating and cooling. The bored cylindrical stem of the flat pen tip 32 is in turn encircled about a portion of its length with a lock ring 46. The locking ring 46 is continuous and increases the frictional contact between the bored stem 34 of the flat pen tip 32 and the annular sheath 38 during the heating. Heat is transferred from the heating element 42 through the sheath 40 and bored stem 34 to the flat-bottom triangular base 36 of the flat pen tip 32.

Figure 4A:
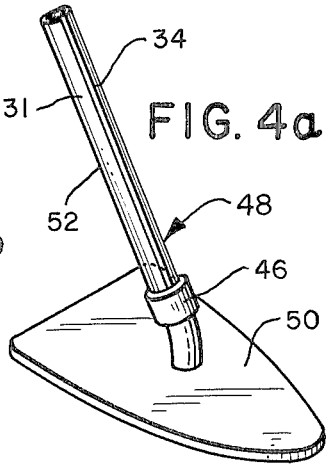
FIG. 4*a* is a perspective view of an alternative pen tip for the heat pen of FIG. 1.
Figure 4B:
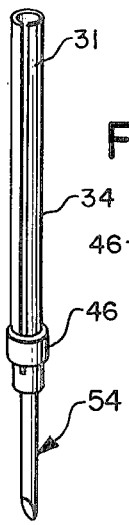
FIG. 4*b* is a perspecitive view of an alternative pen tip for the heat pen of FIG. 1.
Figure 4C:
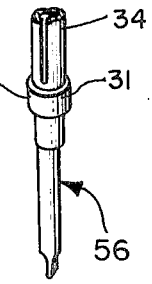
FIG. 4*c* is a perspective view of an alternative pen tip for the heat pen of FIG. 1.
Figure 4D:
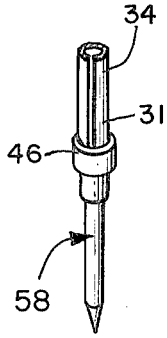
FIG. 4*d* is a perspective view of an alternative pen tip for the heat pen of FIG. 1.

Referring now to FIGS. 4*a*, 4*b*, 4*c*, and 4*d*, a variety of pen tips 31 that can be used are illustrated. Each one of these pen tips 31 have a bored cylindrical stem 34 and a locking ring 46 as described above for the flat pen tip 32, and are easily interchangeable by sliding them on and off the annular sheath 38 of the heat pen 10. An artisan need only be equipped with one heat pen 10 and a variety of pen tips 31 to be able to wax a multiplicity of designs. In FIG. 4*a*, there is shown a modification of the flat pen tip 32, an angled pen tip 48 again with a flat-bottomed base 50. The angle stem 52 is bent at a position in close proximity to the flat-bottomed base 50 so that the main portion of its angled stem 52 is formed straight, so as to receive the straight annular sheath 38 of the heat pen 10 in the same manner as the other pen tips 31. The angled stem 52 allows the flat-bottomed base 50 to be placed directly upon the fabric 14 while the handle 30 of the heat pen 10 is inclined from the vertical in a position convenient for grasping. The angle stem 52 is bent to form an angle approximately midway between 90° and 180° although the exact angle is a matter of personal preference. The pen tips shown in FIGS. 4*b*, 4*c*, and 4*d* all formed with points rather than a flat-bottomed base. In FIG. 4*b*, a wedge-shaped pen tip 54 is particularly suitable for waxing both bottom narrow and broad lines and changing quickly from one to the other by rotating the heat pen 10. In FIG. 4*c*, a double wedged pen trip 56 is particularly suitable for waxing both straight and broad lines depending on the direction of the waxing. In FIG. 4*d*, a pointed pen tip 58 is particularly suitable for waxing fine lines or dots or the like. These pen tips 31 are, of course, only illustrative and modifications therewith are within the ordinary skill of one in the art.

Figure 5:
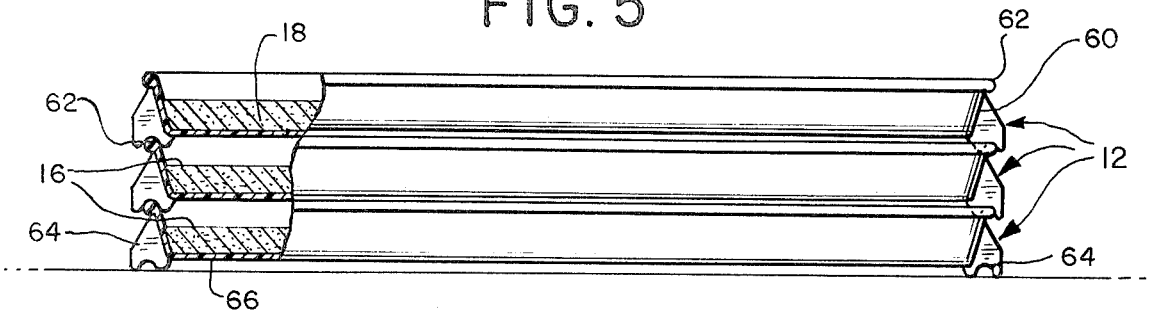
FIG. 5 is an elevated side view of a plurality of wax trays disposed in a stacked arrangement, embodying features of the present invention.

Referring now to FIG. 5 also, the preferred wax tray 12 has a depth from about ½ inch to about 1 inch and is conveniently about 9½ inches wide and 13 inches long. The sides 60 of the wax trays 12 are slightly angled outward and preferably for peripheral stacking flanges or lugs 62. These stacking lugs 62 allow the wax trays 12 to be easily grasped along their edge for transporting from place to place. The wax trays 12 also preferably include a peripheral, downwardly-extending inverted seats 64 at each corner, which interfit with stacking lugs 62 below when one tray 12 is stacked upon another. The inverted seats 64 extend below the bottom 66 of the tray 12 and act as legs therefor when a wax tray 12 is placed directly on a table or the like. The inverted seats 64 allow air to freely circulate below the bottom 66 of the wax trays 12 and thereby facilitate cooling after oven heating, and also facilitate heating to renew the upper surface 16 of the wax 18. In the combination of inverted seats 64 and stacking lugs 62 allows the trays to be stored in relatively small places and also allows a plurality of stacked wax trays 12 to be oven-heated at the same time with minimum space requirements and maximum efficiency of heat circulation.

Figure 6:
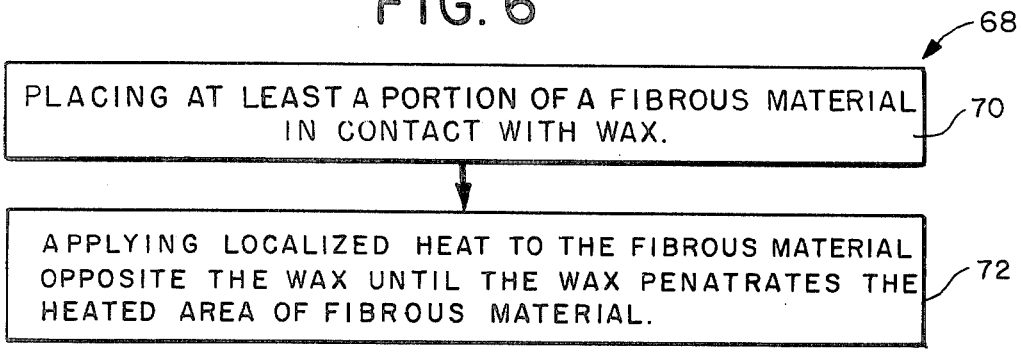
FIG. 6 is a flow diagram of a waxing process embodying features of the present invention.

Referring now to FIG. 6, the waxing process of the present invention, designated generally 68, in its broadest aspect, consists of two steps, the placing of at least a portion of one side at the fibrous material in contact with wax 70 and the subsequent applying localized heat to the fibrous material oppposite the wax until the wax penetrates the heated area of the fibrous material 72. The waxing process 68 is preferably performed with the instrumentality described above but is not necessarily limited thereto. It is necessary that the fibrous material being waxed contact wax along one side, but the contact maybe along the vertical, as well as the horizontal or any other inclination therebetween. The fibrous material may be cloth or paper or other suitable material which can be dyed and which is penetrable by wax. The localized heat may be applied by apparatus other than the heat pen described above so long as there is sufficient control of the heat and the localization to effect suitable waxing. The localized heat could be applied by other instruments, such as a flat iron, a metal rod or the like which can be heated on the stove or in a boiling liquid or the like, but the benefits of the process of the invention will not be fully realized. The heat should be applied for a sufficient period of time to allow the wax to penetrate the fibrous material. When a heat pen as described above is used, the heat applied is even and controlled.

The waxing process 68 may include other optional steps, such as the heating of a wax pan 12 prior to initiation of the work to smooth the wax surface 16. Alternatively, disposable wax pans will be used with a minimum depth of wax 18 so that the wax pan 12 can be discarded rather than heated to renew the wax surface 16. The waxing process 68 may, of course, include steps such as interchanging pen tips during the working and steps 70 and 72 are generally repetitive when an intricate design is being waxed.

Figure 7:
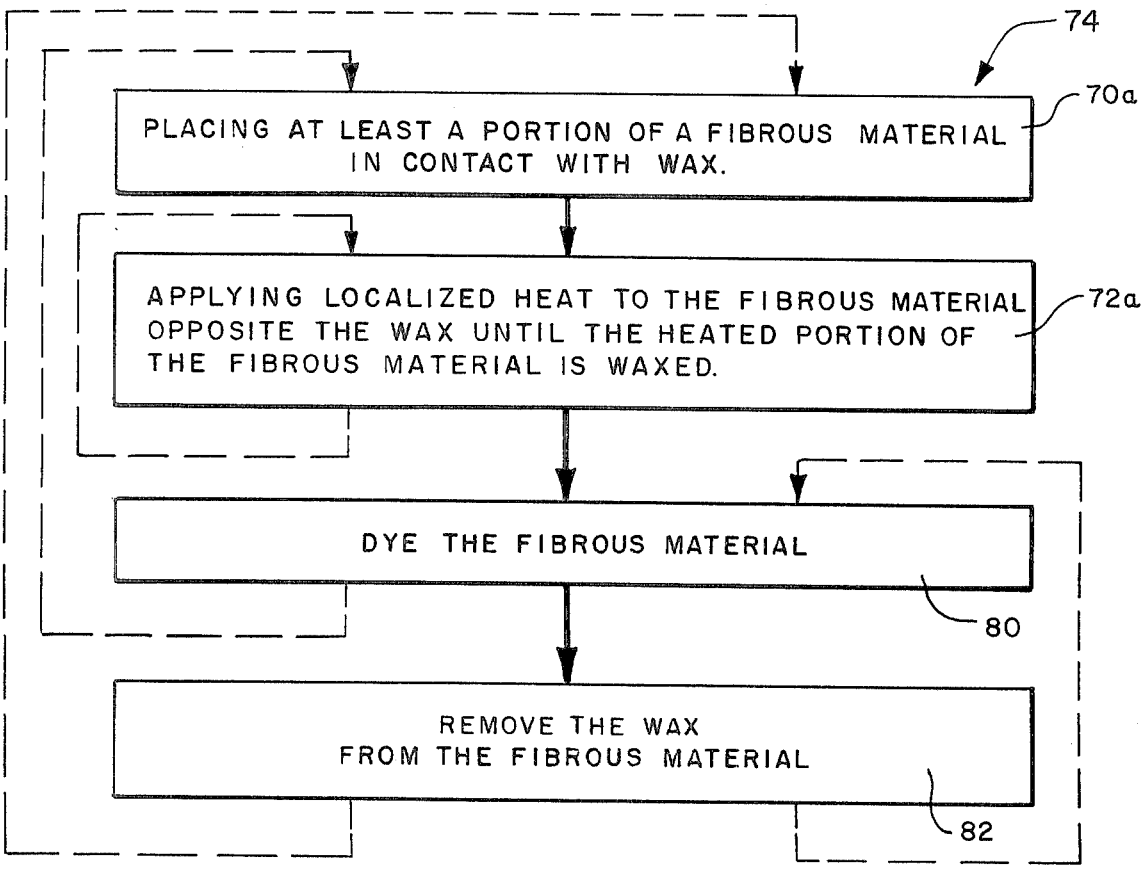
FIG. 7 is a flow diagram of a wax resistant dyeing process embodying features of the present invention.

In FIG. 7 there is illustrated a wax resist dyeing process of the present invention, designated generally 74. The wax resist dyeing process includes steps 70*a* and 72*a* of the waxing process 68, and additionally includes the steps of dyeing the fibrous material 80 and the step of removing the wax from the fibrous material 82. The dyeing step 80 is done under any suitable conditions that will not substantially effect the wax applied to steps 70*a* and 72*a*. Cold dyeing with suitable dyes, as is well known in the art, is preferred. If desired, however, stronger conditions can be used to intentionally disrupt some of the waxing to create a variation in design and uniqueness. The wax removal step 82 can be effectuated with solvents or by ironing the fabric 14 between absorbent paper. Trace amounts of wax can be removed by boiling the fabric in water. Any suitable means for removing the wax without disturbing the applied dye can be utilized for step 82.

The course of the wax resist dyeing process 74 is dependent upon the design to be applied, the variations in color desired, and the color of dyes available for application. An artisan can begin with an unworked fabric, contacting it with the solid wax according to 70*a* and waxing a portion thereof according to step 72*a*. Step 72*a* is necessarily repetative unless a single area of the fabric is to be waxed. When step 78 has been repeated to the extent desired, the fabric is then dyed according to step 80, whereby a color is applied to all portions of the material that have not been waxed. Thereafter, the artisan may repeat the waxing steps 70*a* and 72*a* without removing the wax already present, so as to protect portions of the dyed fabric, and thereafter redye the remaining unwaxed portion, according to step 80. Alternatively, the artisan may go directly from the dyeing step 80 to the step of wax removal 82 and then back to the waxing steps 70*a* and 72*a* or, alternatively, back to the dyeing step 80.

INDUSTRIAL APPLICABILITY

The wax resist dyeing process and the waxing process of the present invention can be utilized to produce an extreme variety of unique, milticolored fabrics or other fibrous materials, conveniently and easily, without destroying the integrity of traditional wax resist principles and realizing therefrom authentic batik designs which cannot be duplicated by modern weaving or printing processes. The apparatus of the present invention is specifically adapted to be used in the processes of the present invention. This apparatus is preferably adapted for hand use by an artisan producing unique designs, but may easily be modified for commercial machine use to provide authentic batik designs by mass production, and make such goods available to the mass market at affordable prices.

The processes and apparatus of the present invention are particularly suitable for use by novice workers, particularly children learning batik or other wax resist techniques in a classroom situation. The processes and apparatus eliminate the hazards that have stifled the teaching of this craft.

I claim:

1. A process for applying a design to a fibrous material by providing a source of wax whereby a portion of said fibrous material can be waxed prior to dyeing so that the waxed portion resists dye, comprising:

maintaining a source of wax in a heatable container;

positioning at least a portion of a fibrous material adjacent said source of wax so that at least a portion of said fibrous material contacts wax about only one of its sides;

applying controlled heat at least to a portion of said fibrous material opposite said wax to melt a portion of said wax so as to wax said portion of fibrous material and repeating;

periodically heating said source of wax to provide a smooth upper surface to said source of wax;

dyeing said fibrous material after said wax portion has cooled under conditions sufficiently mild so as not to substantially destroy the waxed portion; and optionally removing the wax prior to repeating the steps of waxing and dyeing.

2. The process of claim 1 wherein said source of wax underlies said fibrous material when the controlled heat is applied.

3. The process of claim 1 wherein said source of wax and said heatable container is a tray containing wax, and said periodic heating is provided by placing said wax tray in an oven.

4. The process of claim 3, further including providing a plurality of said wax trays with means for stacking said wax trays one above another in spaced-apart relationship, and placing more than one of said wax trays in said oven in stacked, spaced-apart relationship to achieve said periodic heating of each of said wax trays.

* * * * *